US005660556A

United States Patent [19]

Badaroux et al.

[11] Patent Number: 5,660,556

[45] Date of Patent: Aug. 26, 1997

[54] ELECTRICAL CONNECTORS

[75] Inventors: Thierry Badaroux, St-Germain en Laye; Jean Ittah, Villeneuve la Garenne, both of France

[73] Assignee: Connecteurs Cinch, Montigny le Bretonneux, France

[21] Appl. No.: 595,998

[22] Filed: Feb. 6, 1996

[30] Foreign Application Priority Data

Feb. 13, 1995 [FR] France ..... 95 01630

[51] Int. Cl.[6] ..... H01R 13/62

[52] U.S. Cl. ..... 439/310; 439/347; 439/157

[58] Field of Search ..... 439/310, 152–157, 439/147, 345, 350, 347, 701

[56] References Cited

U.S. PATENT DOCUMENTS 4,586,771 5/1986 Kraemer et al. .
5,169,327 12/1992 Hatagishi .
5,183,408 2/1993 Hatagishi .

FOREIGN PATENT DOCUMENTS 2123276 11/1994 Canada .
2123972 11/1994 Canada .
0624926 11/1994 European Pat. Off. .
0625809 11/1994 European Pat. Off. .

OTHER PUBLICATIONS

French Search Report and Annex.

*Primary Examiner*—Khiem Nguyen
*Attorney, Agent, or Firm*—Greenblum & Bernstein P.L.C.

[57] ABSTRACT

An electrical connector includes a locking key having branches that slide in a female housing member. The branches include ramps to receive studs on a male housing member. The edge of the branches includes a strip with a lug engaged in an opening in the member which has a tongue with a protuberance on it to immobilize the lug in the opening when the key is in a ready position and which can be retracted when the key is pushed towards a locked position.

3 Claims, 5 Drawing Sheets

ELECTRICAL CONNECTORS

BACKGROUND OF THE INVENTION

1. Field of the Invention

The present invention concerns electrical connectors.

2. Description of the Prior Art

The invention concerns electrical connectors that comprise a female housing member, a male housing member adapted to be partially inserted into the female housing member and a U-shape locking key with two branches guided by slots in the female housing member, each branch including ramps adapted to cooperate with studs on the male housing member so that, from a ready position of the key in which the studs can interengage with the raps, sliding the key towards a locked position firstly engages the male housing member in the female housing member and secondly locks it therein.

One drawback of a connector of this kind is that the key can be unintentionally removed from the housing member.

One object of the present invention is to remedy this drawback.

SUMMARY OF THE INVENTION

The present invention consists in improvements to electrical connectors of the type comprising a female housing member adapted to receive a male housing member, a locking key in the form of a U-shape body with two branches and a core, said branches being guided in slots at one end of said female housing member and including ramps adapted to cooperate with studs on said male housing member so that in a ready position in which said branches are partly inserted in said female housing member said studs can interengage with said ramps and in a locked position said branches are entirely housed within said female housing member and said male housing member engaged and immobilized in said female housing member, said connector including means for opposing withdrawal of said branches from said slots in said female housing member when said key is engaged in said female housing member, means for locking said key in said ready position and means for releasing said key when it is pushed from its ready position to its locked position, said improvements consisting in at least one branch of said locking key having along one edge an elastic strip provided on its exterior face with a lug adapted in said ready position to engage in a corresponding opening in said female housing member and in said locked position to cooperate with a notch in said female housing member, the latter comprising in at least one of its walls a cut-out elastic tongue facing said opening and having a protuberance on it, the corresponding branch of said key having, in line with said elastic strip, a recess so that when said protuberance is engaged in said hollow the free end of said tongue cooperates with said elastic strip and opposes any movement of the latter, whereas when said protuberance is disengaged from said hollow the free end of said tongue is offset laterally and said elastic strip can flex freely, so that said lug can be disengaged from said opening.

Using this arrangement, the key is effectively immobilized in the ready position but is easily pushed towards the locked position, which is a secure position.

To enable the lug to prevent withdrawal of the key from the female housing member, said lug has a step face on the side facing towards the core and an inclined ramp surface on the opposite side to facilitate disengaging it from the opening to move the key to the locked position.

Finally, in accordance with a final feature of the invention, at least one branch of the key has a notch adapted to receive the protuberance on the tongue in the locked position.

The invention will now be described in more detail with reference to a specific embodiment shown by way of example only in the appended drawings.

DETAILED DESCRIPTION OF THE PREFERRED EMBODIMENT

Figure 1:
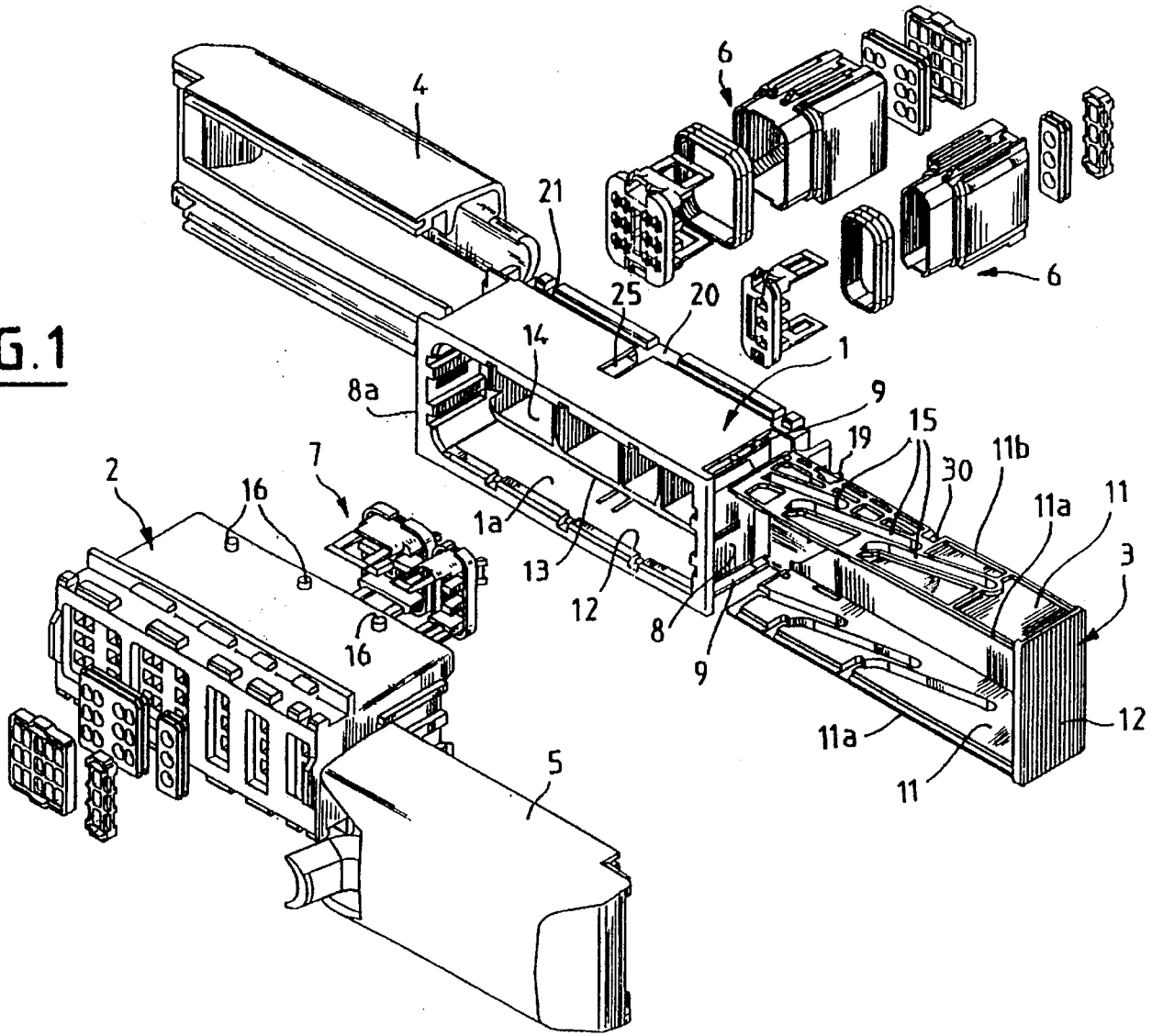
FIG. 1 is an exploded perspective view of a connector in accordance with the invention.
Figure 2:
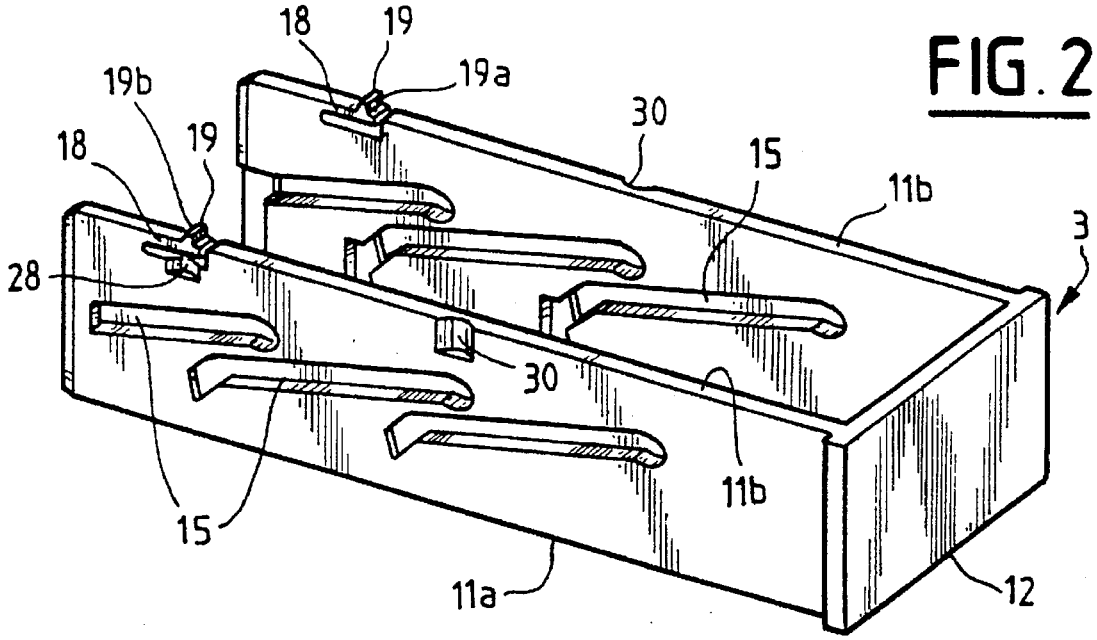
FIG. 2 is a perspective of the locking key of the connector from FIG. 1.
Figure 6:
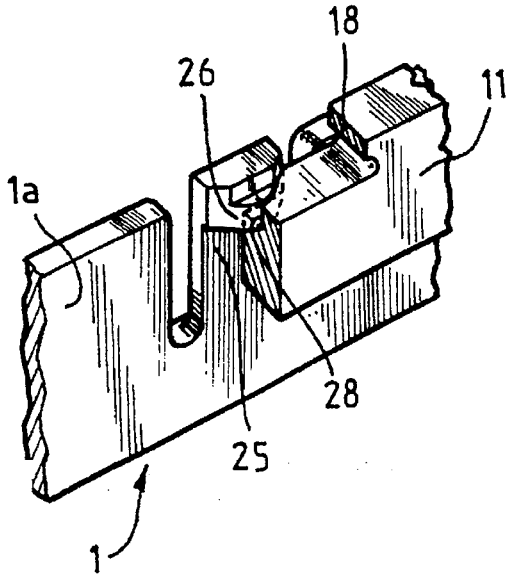
FIGS. 6 and 7 are perspective views of a detail.

In the embodiment shown in the figures the connector comprises a female housing member 1, a male housing member 2, a key 3 for joining and locking the two housing members together, a cover 4 for the female housing member 1 and a cover 5 for the male housing member 2.

In this embodiment the female housing member 1 receives a series of sub-housings 6 containing a number of male, female or hermaphrodite contact members and the male housing member 2 receives sub-housings 7 containing electrical contact members complementary to those housed in the sub-housings 6.

The female housing member has two side walls 1*a* and two end walls 8 and 8*a*.

The key 3 is a U-shape body with two branches 11 and a core 12, said branches being adapted to be inserted into two parallel slots 9 and the end wall 8 of the housing member 1.

One edge 11*a* of the branches 11 is guided by a groove 12 in the female housing member 1. The other edge 11*b* is inserted in a slot 13 provided between compartments 14 adapted to receive the sub-housings 6 and the side wall of said member 1.

Each branch 11 includes three ramps 15 which open onto their edge 11*a* and which diverge from said edge as far as a point near the core 12.

The ramps 15 are designed to cooperate with studs 16 on two opposite sides of the housing member 2, firstly for engagement of said housing member 2 in the housing member 1 and, secondly, for locking these two housing members together.

Each branch 11 has a cut-out strip 18 near the free end of its edge 11*b*; its outside face carries a lug 19 which has a step face 19*a* on the side facing towards the free end of the strip 18 and a ramp surface 19*b* on the opposite side.

At an intermediate point corresponding to a ready position of the key 3, and in which the ends of the ramps 15 opening onto the edge 11*a* are disposed so that they can receive the studs 16, openings 20 are formed in the bottom of the slots 9 and into which the lugs 19 are inserted.

A notch 21 in the bottom of the slots 9 is adapted to receive the corresponding lug 19 in the locked position of the key 3.

The female housing member 1 has a cut-out tongue 25 in each of its side walls 1*a*, with a protuberance 26 on the same side as the slot 9 near its free end.

The key 3 has near the edge 11*b* of each branch 11 a hollow 28 in line with each strip 18, said hollow being adapted to receive the protuberance 26 in the ready position of the key 3.

Near the edge 11*b* of each branch 11 is a notch 30 that can receive the protuberance 26 in the locked position of the key 3.

Figure 3:
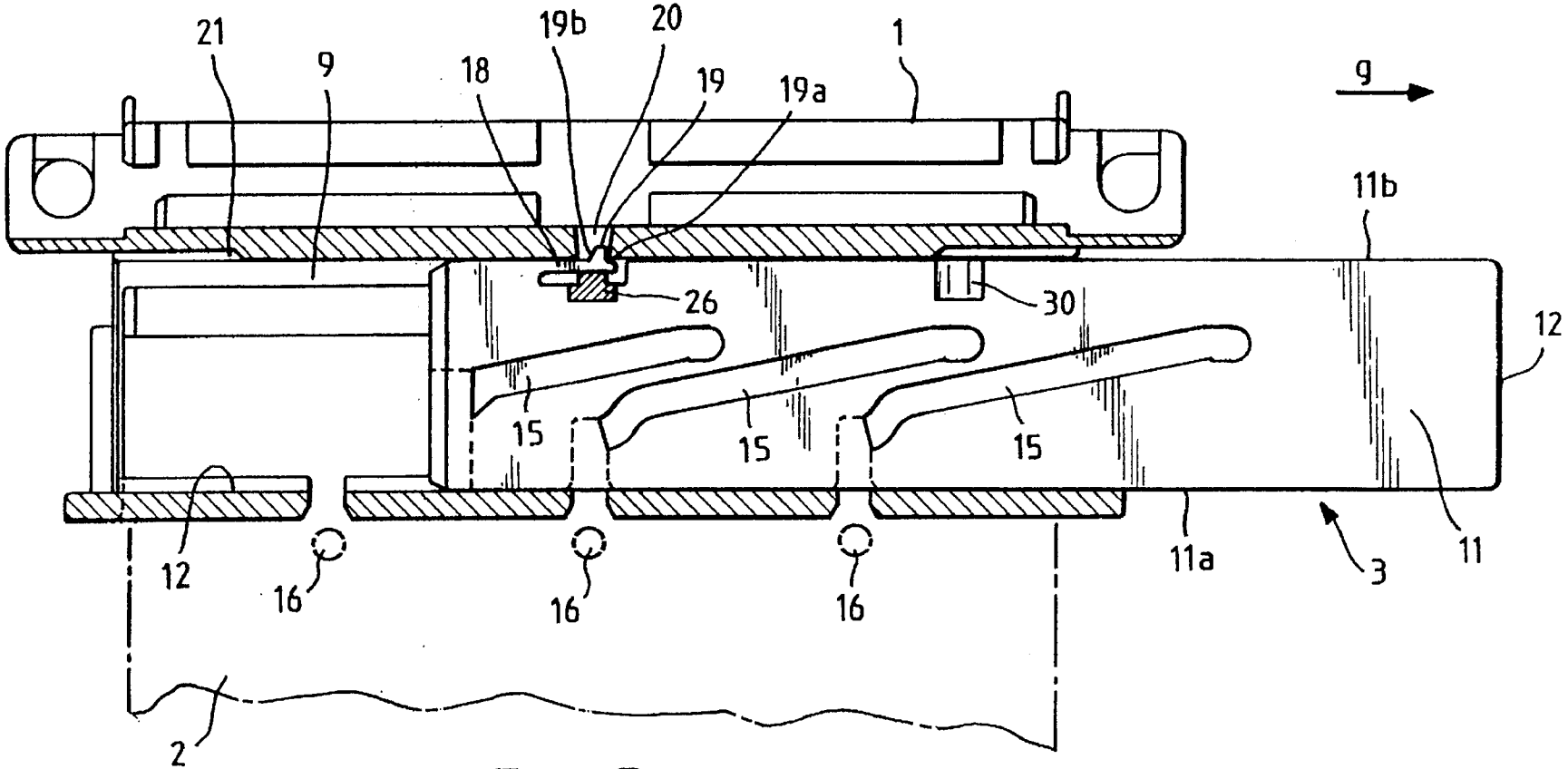
FIG. 3 is a part-sectional elevation view showing the key in the open position.

As shown in FIG. 3, when the key 3 is in the ready position the lugs 19 are inserted in the openings 20, the free ends of the tongues 25 bear against the bottom face of the strips 18, the protuberances 26 are inserted in the hollows 28 and the step faces 19*a* bear against the corresponding edge of the openings 20.

The key is immobilized in this position and cannot be moved in the direction of the arrow 9 (FIG. 3). Accordingly, there is no risk of the key becoming unintentionally separated from the female housing member 1.

Figure 7:
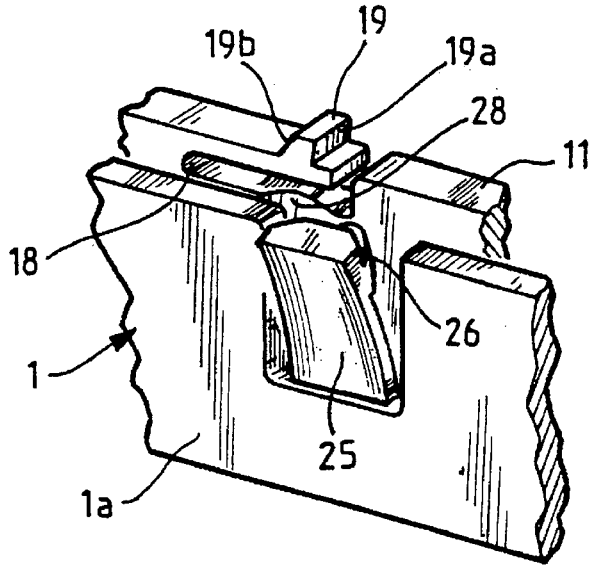
Figure 4:
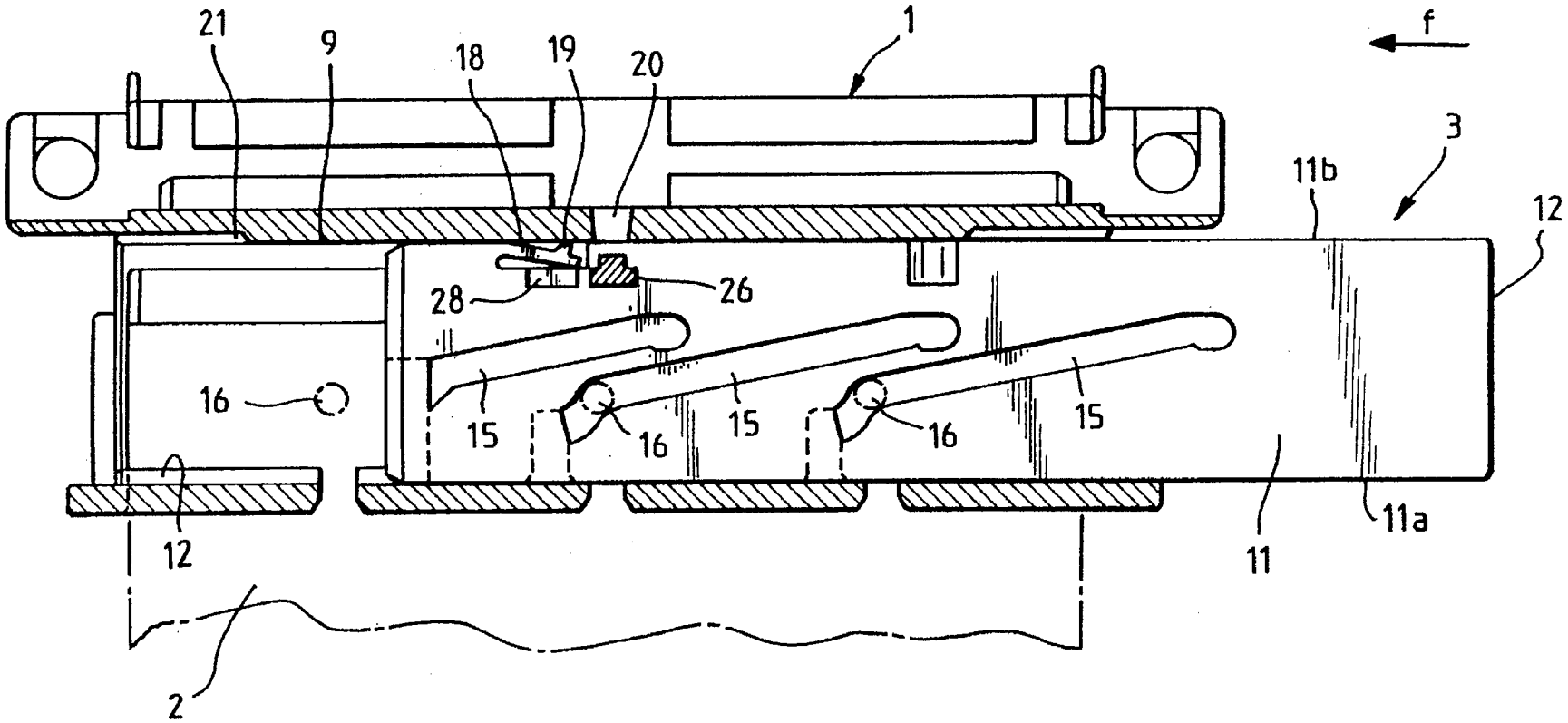
FIG. 4 is a view similar to FIG. 3 showing the key pushed towards the locked position.
Figure 5:
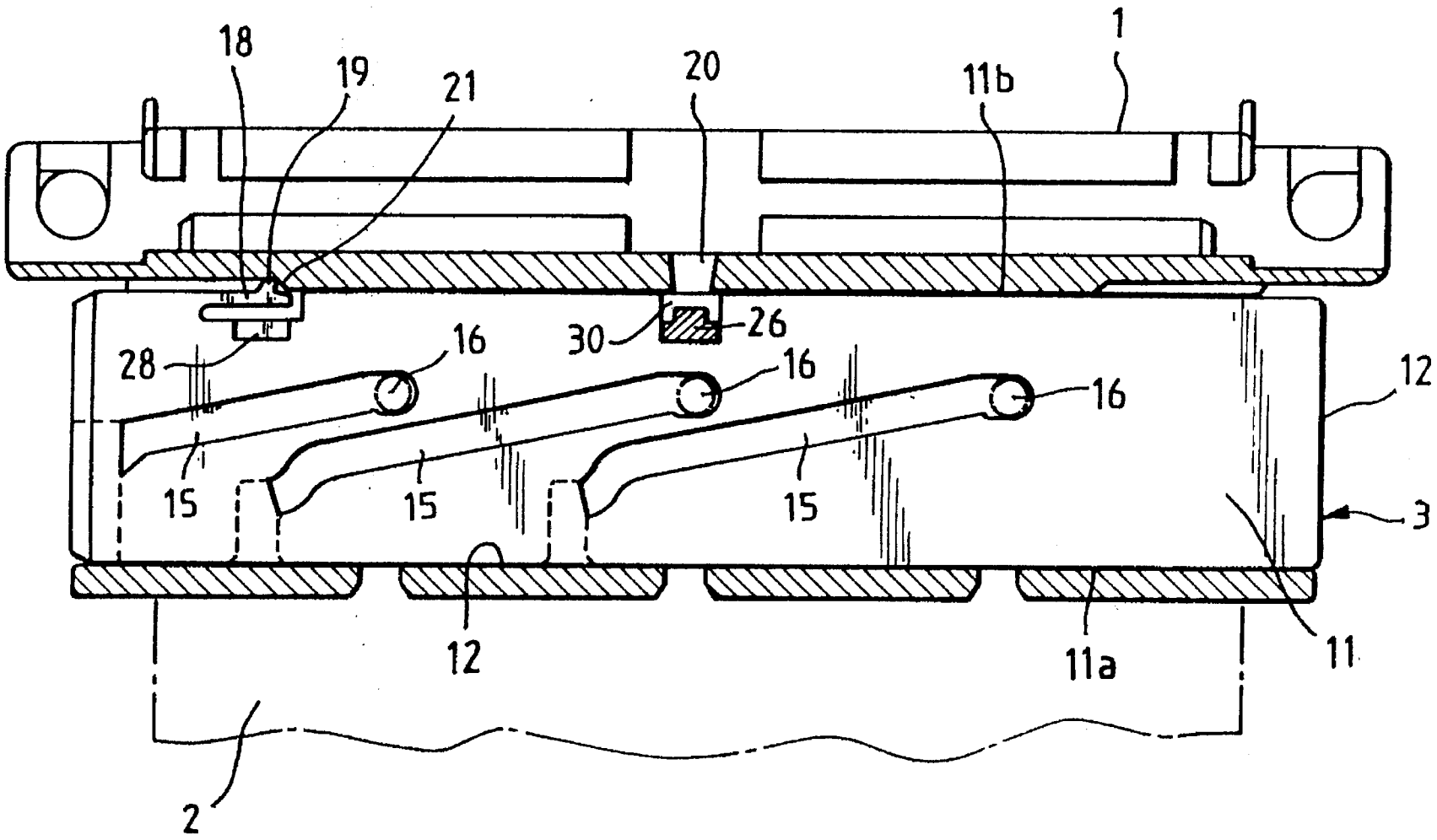
FIG. 5 is a view analogous to FIGS. 3 and 4 showing the key locked.

However, after inserting the housing member 2, to allow the key 3 to move in the direction of the arrow f (FIG. 4) the protuberances 26 are released from the hollows 28 so that the tongues 25 bend at their base, with the result that their free ends of offset laterally so that the strips 18 can flex freely (FIGS. 4 and 7). Because of the ramps 19*b*, the lugs 19, cooperating with the corresponding edge of the openings 20, can disengage from the latter.

The key 3 can then be pushed (in the direction of the arrow f) to the locked position, in which the lugs 19 are inserted in the notches 21 and the protuberances 26 are engaged in the notches 30.

Note that the notches 21 are slightly inclined to allow the key to be moved back to its ready position.

Of course, the invention is not limited to the embodiment shown and just described. Numerous modifications of detail may be made thereto without departing from the scope of the invention.

There is claimed:

1. Improvements to electrical connectors of the type comprising a female housing member adapted to receive a male housing member, a locking key in the form of a U-shape body with two branches and a core, said branches being guided in slots at one end of said female housing member and including ramps adapted to cooperate with studs on said male housing member so that in a ready position in which said branches are partly inserted in said female housing member said studs can interengage with said ramps and in a locked position said branches are entirely housed within said female housing member and said male housing member engaged and immobilized in said female housing member, said connector including means for opposing withdrawal of said branches from said slots in said female housing member when said key is engaged in said female housing member, means for locking said key in said ready position and means for releasing said key when it is pushed from its ready position to its locked position, said improvements consisting in at least one branch of said locking key having along one edge an elastic strip provided on its exterior face with a lug adapted in said ready position to engage in a corresponding opening in said female housing member and in said locked position to cooperate with a notch in said female housing member, the latter comprising in at least one of its walls a cut-out elastic tongue facing said opening and having a protuberance on it, the corresponding branch of said key having, in line with said elastic strip, a hollow so that when said protuberance is engaged in said hollow the free end of said tongue cooperates with said elastic strip and opposes any movement of the latter, whereas when said protuberance is disengaged from said hollow the free end of said tongue is offset laterally and said elastic strip can flex freely, so that said lug can be disengaged from said opening.

2. Improvements to electrical connectors according to claim 1 wherein said lug has a step face on the side facing towards said core and an inclined ramp face on the opposite side.

3. Improvements to electrical connectors according to claim 1 wherein at least one branch of said key has a notch adapted to receive said protuberance on said tongue in said locked position.

* * * * *